US006245004B1

(12) United States Patent
Waters

(10) Patent No.: US 6,245,004 B1
(45) Date of Patent: Jun. 12, 2001

(54) MACHINE FOR PERFORMING A MANUFACTURING OPERATION ON A SHEET OF MATERIAL AND METHOD OF OPERATION

(76) Inventor: Michael A. Waters, 831 Boyle Rd., Fairfield, PA (US) 17320

( * ) Notice: Subject to any disclaimer, the term of this patent is extended or adjusted under 35 U.S.C. 154(b) by 0 days.

(21) Appl. No.: 09/362,250

(22) Filed: Jul. 28, 1999

(51) Int. Cl.[7] ..... B31B 1/25

(52) U.S. Cl. ..... 493/61; 493/65; 493/473; 493/475

(58) Field of Search ..... 443/61, 65, 63, 443/59, 475, 478, 473

(56) References Cited

U.S. PATENT DOCUMENTS

| | | | | |
|---|---|---|---|---|
| Re. 35,345 | | 10/1996 | Adami | 493/355 |
| 3,611,500 | * | 10/1971 | Carrigan et al. . | |
| 3,866,523 | | 2/1975 | Geschwender | 93/58 ST |
| 4,257,317 | * | 3/1981 | Yoshida et al. . | |
| 4,822,325 | * | 4/1989 | Vossen . | |
| 4,946,430 | * | 8/1990 | Kohmann . | |
| 4,994,008 | | 2/1991 | Haake et al. | 493/2 |
| 5,120,297 | * | 6/1992 | Adami . | |
| 5,904,643 | * | 5/1999 | Seeberger et al. . | |
| 5,964,686 | * | 10/1999 | Bidlack et al. . | |

* cited by examiner

*Primary Examiner*—Eugene Kim
(74) *Attorney, Agent, or Firm*—James M Trygg

(57) ABSTRACT

A machine (10) for performing a manufacturing operation on a sheet of material (12) includes an upper tool (282, . . . ) for engaging an upper surface (602) of the sheet of material (12) and a lower tool (380, . . . ) mateable with the upper tool for engaging a lower surface (606) of the material opposite to the upper surface. The upper and lower tools are arranged to cooperate in performing the manufacturing operation. A drive mechanism (456, 522, . . . ) is provided for causing relative movement between the tools and the sheet of material, back and forth along a first axis (24) and back and forth along a second axis (518) substantially perpendicular to the first axis while performing the manufacturing operation. The invention includes a method of performing the manufacturing operation utilizing the machine (10).

23 Claims, 15 Drawing Sheets

MACHINE FOR PERFORMING A MANUFACTURING OPERATION ON A SHEET OF MATERIAL AND METHOD OF OPERATION

The present invention relates to a machine for performing a manufacturing operation on a sheet of material and more particularly to such a machine having upper and lower tools for cooperatively engaging both sides of the sheet of material in the performing of the manufacturing operation.

BACKGROUND OF THE INVENTION

Machines are commercially available for manufacturing box blanks, templates, etc. from a sheet of material. Such machines generally are called "sample makers" in the industry. Typically, they perform various manufacturing operations such as creasing, cutting, perforating, milling, marking, and similar operations on a sheet of material that is held on a table of the machine. Is some cases the sheet of material is tightly secured to a table, either by vacuum or by clamps and the tool is moved by means of an X-Y mechanism to perform the manufacturing operation on the upwardly facing surface of the material. In other cases the sheet of material is moved back and forth along one axis of motion and the tool is moved back and forth along another axis of motion perpendicular to the first axis. Such a machine is disclosed in U.S. Pat. No. 4,994,008 which issued Feb. 18, 1991 to Haake et al. The '008 patent discloses a machine having a large table for receiving a sheet of material. The sheet of material is fed through an operating unit that includes several tool heads that operate on vertically disposed slides for performing the various manufacturing operations on the sheet. As the sheet is fed back and forth along one axis the tool heads track along horizontal lines, and as the sheet is held stationary the tool heads move up and down vertically to track along vertical lines. The tools, however, engages only one side of the sheet of material when performing their manufacturing operation pressing the material of the sheet against the flat surface of the table. Therefore, when creasing for example, the crease is simply an indentation in the outwardly facing surface of the sheet. When the sheet of material is relatively thick and stiff, or hard, as the blank is made to bend about such a crease the outer portions of the surface of the sheet at the bend tend to fracture and split. To overcome this problem mating upper and lower dies are used in a press to form crease lines that are indented on one surface and are outdented on the opposite surface. This provides sufficient displaced material along the crease line that, when bent, there is no fracturing or splitting. However, such dies are relative expensive to manufacture and a unique set of dies is needed for each different size and shape of box or other item being manufactured. Therefore, such dies are not economically suitable for use in making samples in low quantities.

What is needed is a machine capable of forming a crease line having an indent in one surface and an out-dent on the opposite surface formed by tools that concurrently engage both sides of the sheet of material, wherein the tools and the sheet of material undergo relative movement in first and second mutually perpendicular directions. The movements of the tools in tracking the desired crease lines should be computer controlled and the tools quickly changeable for fast, economical manufacturing of low quantities of boxes or other items.

SUMMARY OF THE INVENTION

A machine is provided for performing a manufacturing operation on a sheet of material. The machine includes a frame, an upper tool coupled to the frame for engaging an upper surface of the sheet of material and a lower tool coupled to the frame and mateable with the upper tool for engaging a lower surface of the material opposite to the upper surface. The upper and lower tools are arranged to cooperate in performing the manufacturing operation. A drive mechanism is coupled to the frame for causing relative movement between the tools and the sheet of material back and forth along a first axis and back and forth along a second axis substantially perpendicular to the first axis while performing the manufacturing operation. The invention includes a method of performing a manufacturing operation on a sheet of material having an upper surface and a lower surface, utilizing a machine. The machine includes a frame, an upper tool coupled to the frame and a lower tool coupled to the frame and mateable with the upper tool, the upper and lower tools arranged to cooperate in performing the manufacturing operation, and a drive mechanism coupled to the frame for causing relative movement between the tools and the sheet of material back and forth along a first axis and back and forth along a second axis substantially perpendicular to the first axis while performing the manufacturing operation. The manufacturing operation includes the steps of:

(1) causing the upper and lower tools to operationally engage the upper and lower surfaces of the sheet of material;

(2) causing the drive mechanism to effect the relative movement along the first axis while performing a portion of the manufacturing operation; and (3) causing the drive mechanism to effect the relative movement along the second axis while performing another portion of the manufacturing operation.

An embodiment of the invention will now be described by way of example with reference to the following drawings.

DESCRIPTION OF AN EMBODIMENT OF THE INVENTION

Figure 1:
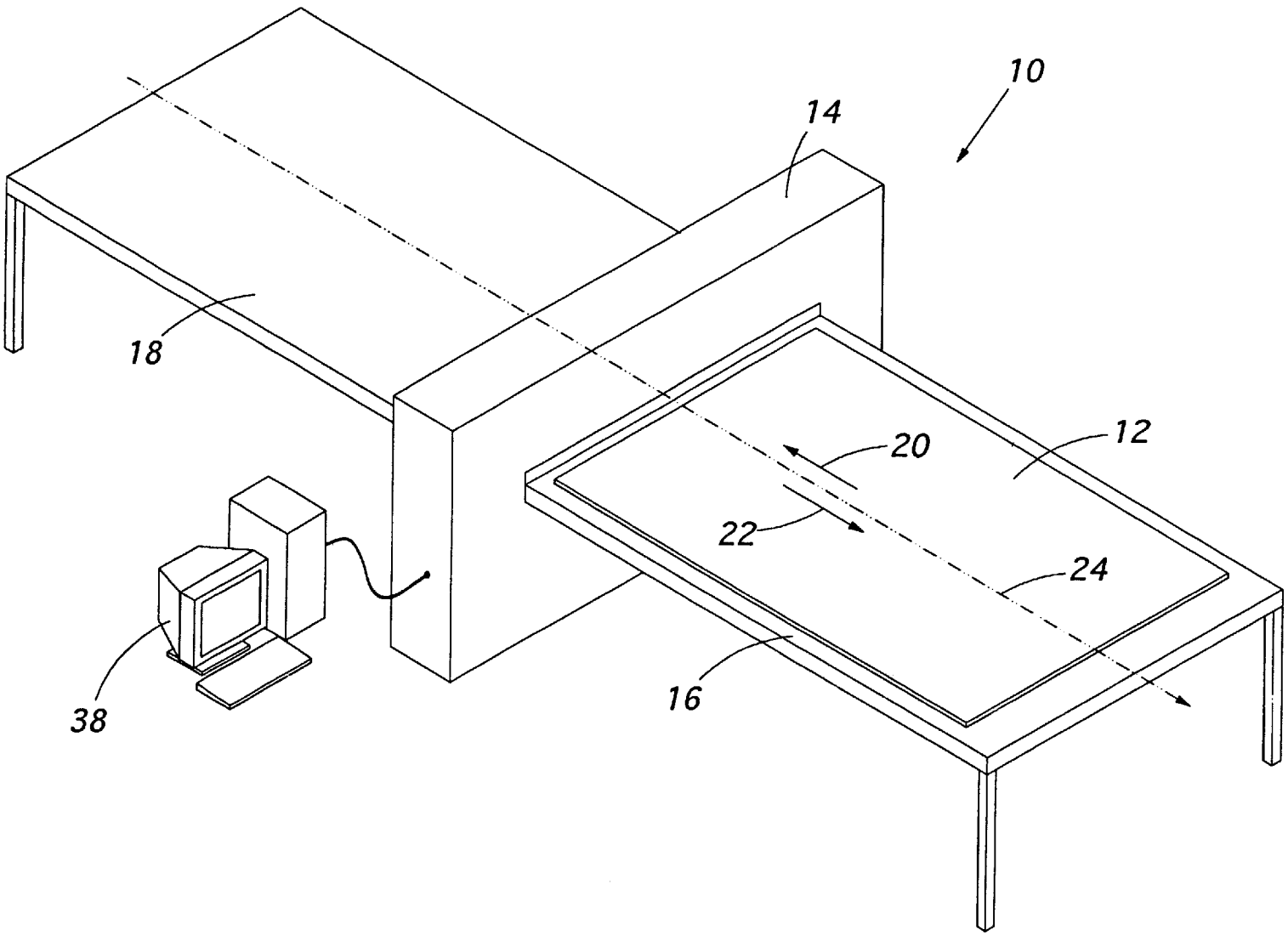
FIG. 1 is an isometric view of a machine incorporating the teachings of the present invention.
Figure 2:
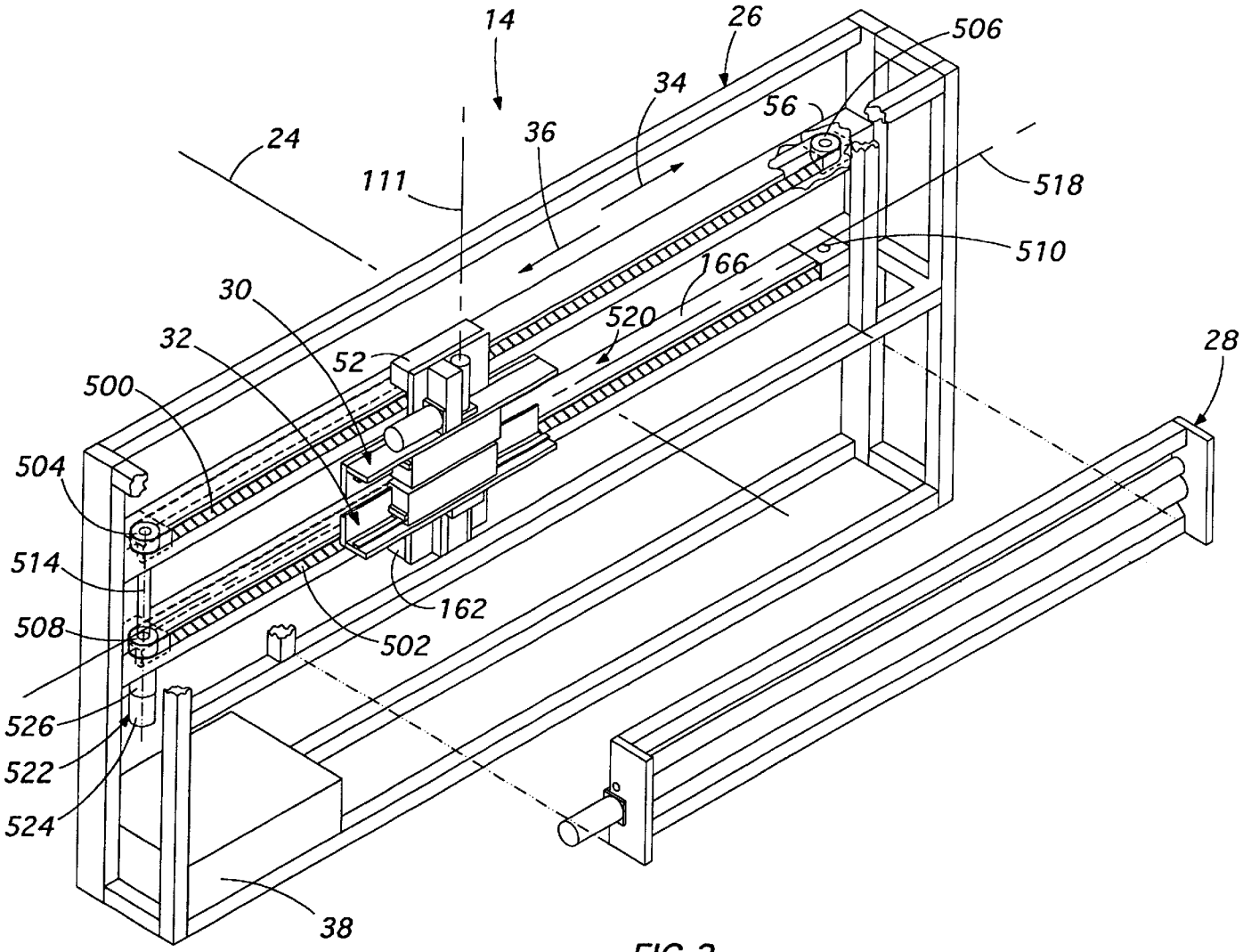
FIG. 2 is an isometric view of the machine shown in FIG. 1 with the covers and table removed and the feed roller assembly offset.

There is shown in FIG. 1 a machine 10 for performing a manufacturing operation on a sheet of material 12. The machine includes a main operating unit 14, an inlet table 16 to support the sheet of material 12 as it is being fed into the operating unit 14, and an outlet table 18 for supporting the sheet of material as it is being fed through the operating unit 14 and after the manufacturing operation is complete. During operation the sheet of material 12 is fed back and forth in the directions of the arrows 20 and 22 along a first axis 24. The operating unit 14, with its covers removed, is shown in FIG. 2. As shown, the operating unit 14 includes a frame 26, a feed roller mechanism 28 that is used to feed the sheet of material 12 back and forth in the directions of the arrows 20 and 22, and upper and lower tool holder assemblies 30 and 32, respectively. The upper and lower tool holder assemblies 30 and 32 are slidingly attached to the frame 26 so that they can move lateral with respect to the first axis 24, back and forth in the directions of the arrows 34 and 36, as will be explained in detail below. A programmable controller 38, including a personal computer (PC), is interconnected to the operating unit 14, as shown in FIG. 1, and controls the operation of the machine 10, in a manner that will be described.

Figure 3:
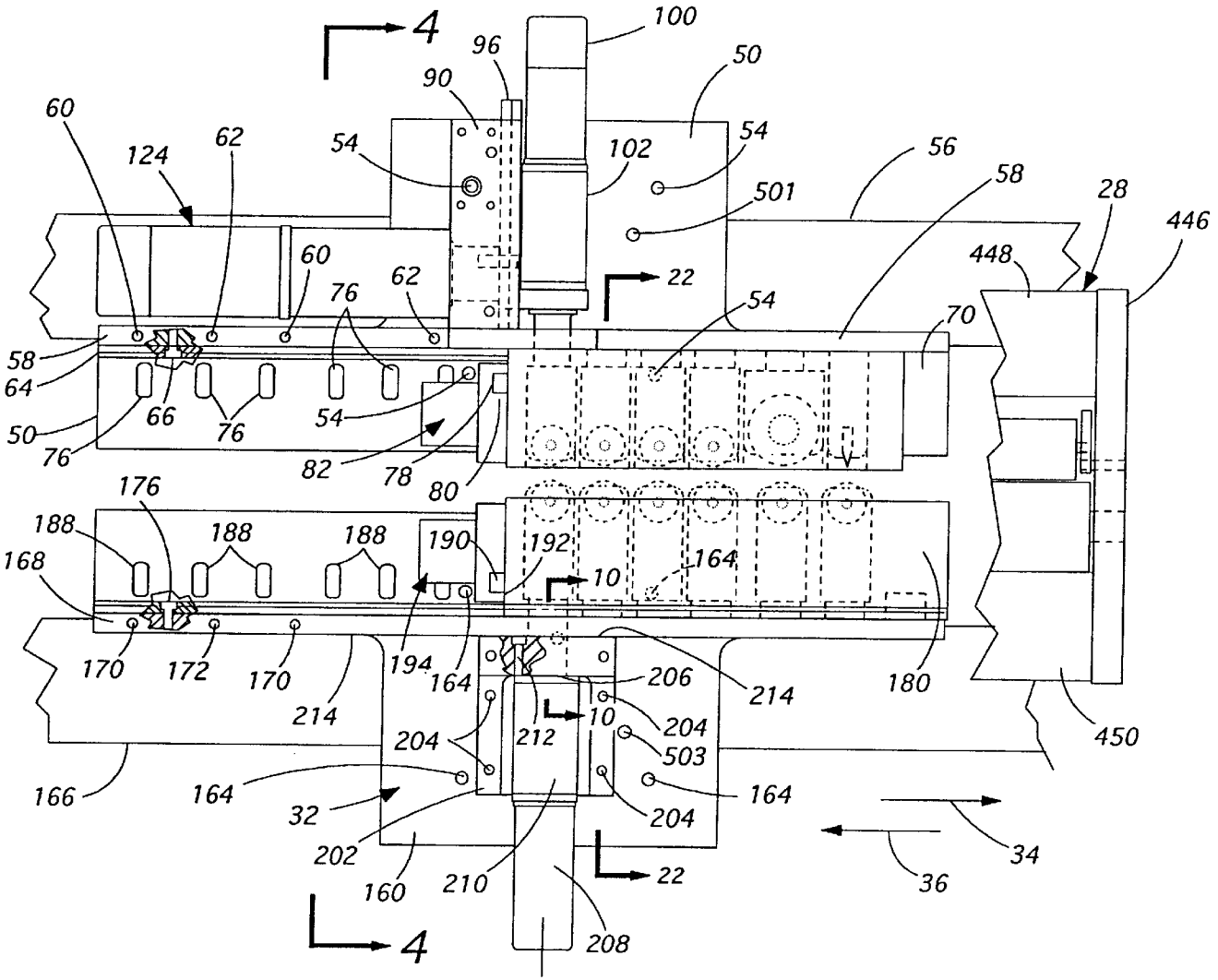
FIG. 3 is a partial front view of the machine shown in FIG. 2 with the feed roller assembly cut away to show the upper and lower tool holder assemblies.
Figure 4:
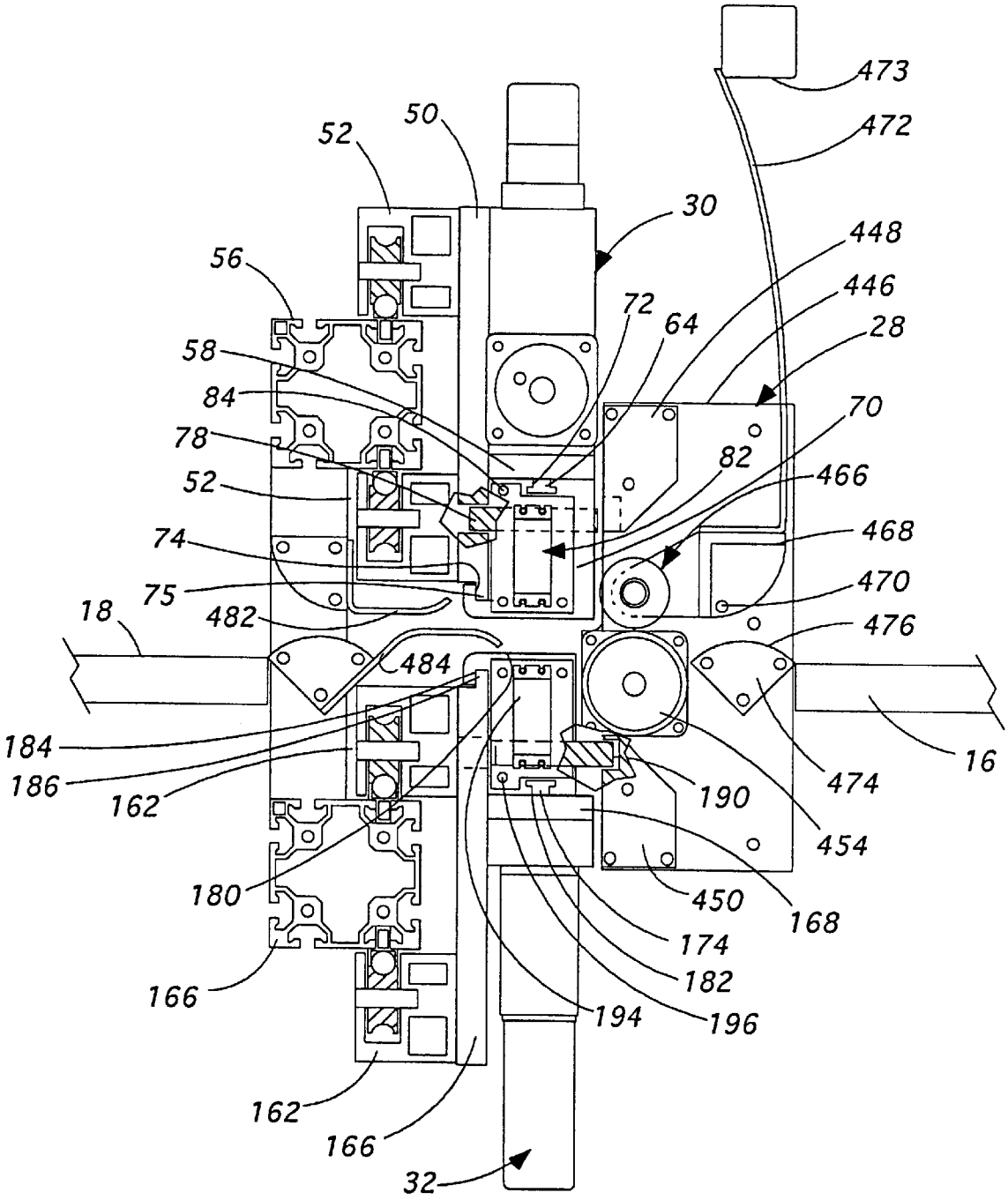
FIG. 4 is a cross-sectional view taken along the lines 4—4 in FIG. 3.
Figure 11:
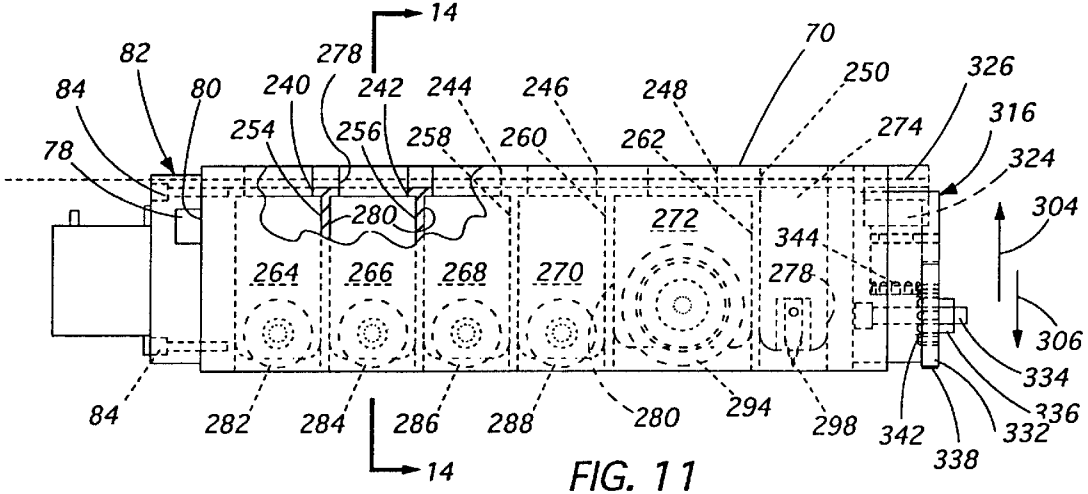
FIG. 11 is an enlarged front view of the upper tool holder assembly shown in FIG. 3.

As best seen in FIGS. 3 and 4, the upper tool holder assembly 30 includes an upper slide plate 50 attached to a pair of movable slide members 52 by means of bolts 54 which extend through counter bored holes in the upper slide plate and into threaded holes in the slide members 52. The pair of slide members 52 are slidingly coupled to and slide along an upper rail 56 which extends the length of the frame 26 and is attached thereto at opposite ends to form an integral part of the frame. An upper tool support plate 58 is attached to the upper slide plate 50, at right angles thereto, by means of screws 60 that extend into threaded holes in the upper slide plate. Dowel pins 62 extend through slip fit holes in both the support plate 58 and the slide plate 50 and are spaced between adjacent screws 60 to accurately locate the support plate, in the usual manner. A T-shaped slide member 64 is attached to the downwardly facing side of the upper tool support plate 58, as best seen in FIG. 4, by means of screws 66 that extend through counter bored holes in the T-shaped member 64 and into threaded holes in the support plate 58. An upper tool holder 70 includes a T-slot 72 that is a close sliding fit with the T-shaped member 64 so that the upper tool holder is free to slide back and forth along the T-shaped member, in the directions of the arrows 34 and 36, as shown in FIG. 3, without appreciable side play. The upper tool holder 70 includes a groove 74 that is a sliding fit with a flange 75 extending from the upper slide plate 50, as shown in FIG. 4, and serves to provide side to side stability without placing undue stress on the T-shaped member 64. Several equally spaced elongated holes 76 are formed through the upper slide plate 50 and extend the entire length of the upper slide plate. A rectangular shaped locking bolt 78 is a slip fit with an opening 80 formed through a servo assembly 82 that is mounted to the left end of the upper tool holder 70 by means of screws 84 that extend through counter bored holes in the servo assembly and into threaded holes in the upper too holder, as shown in FIGS. 3 and 11. The locking bolt 78 is positioned to be closely received in each of the elongated holes 76 so that the upper tool holder can be moved and then locked into any of several positions with respect to the upper slide plate 50. The servo motor of the servo assembly 82, under the command of the controller 38, moves the locking bolt 78 into and out of locking engagement with the elongated holes 76, as will be explained in more detail below.

Figure 5:
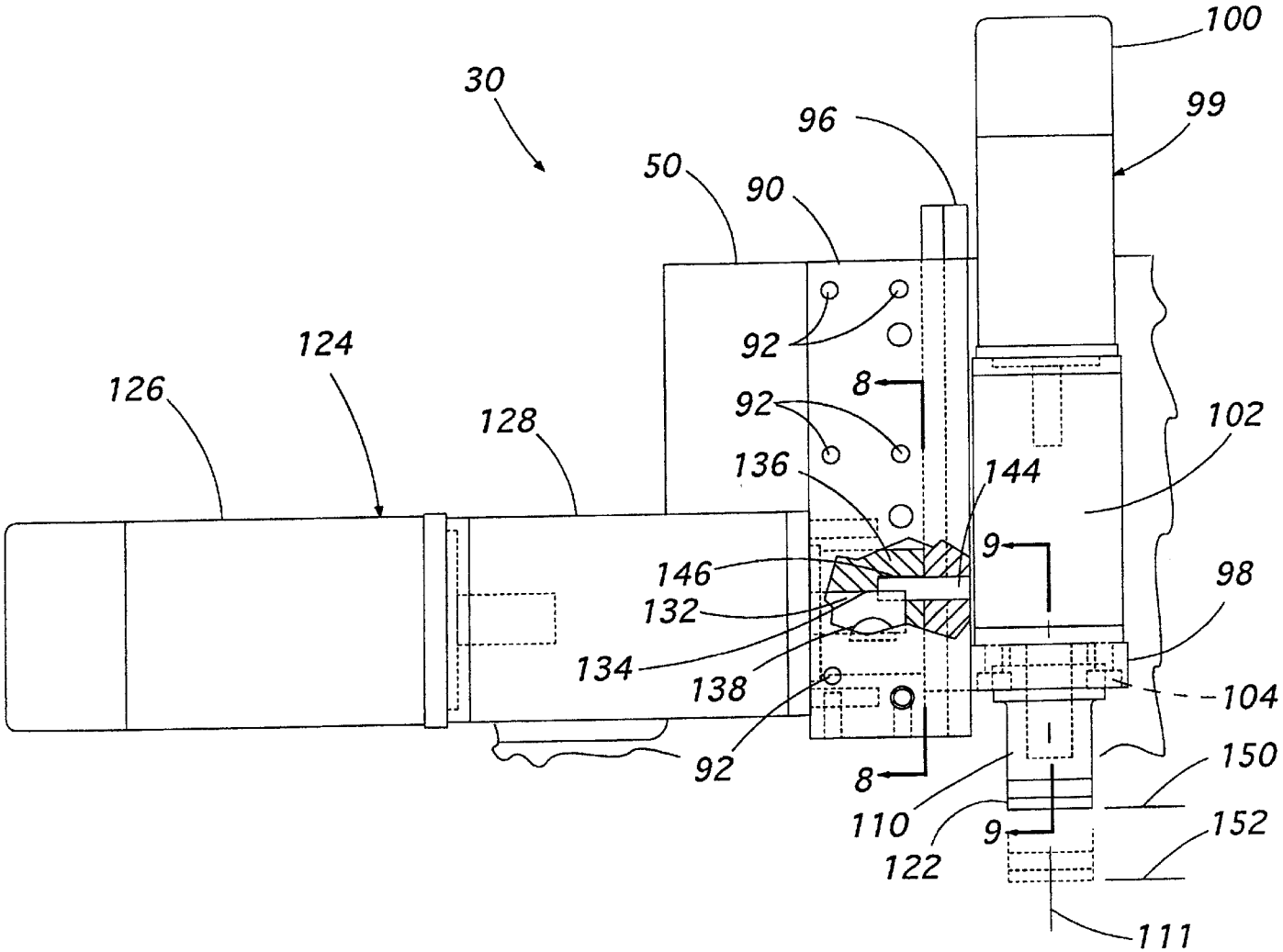
FIG. 5 is an enlarged view of the upper tool activator assembly shown in FIG. 3.
Figure 6:
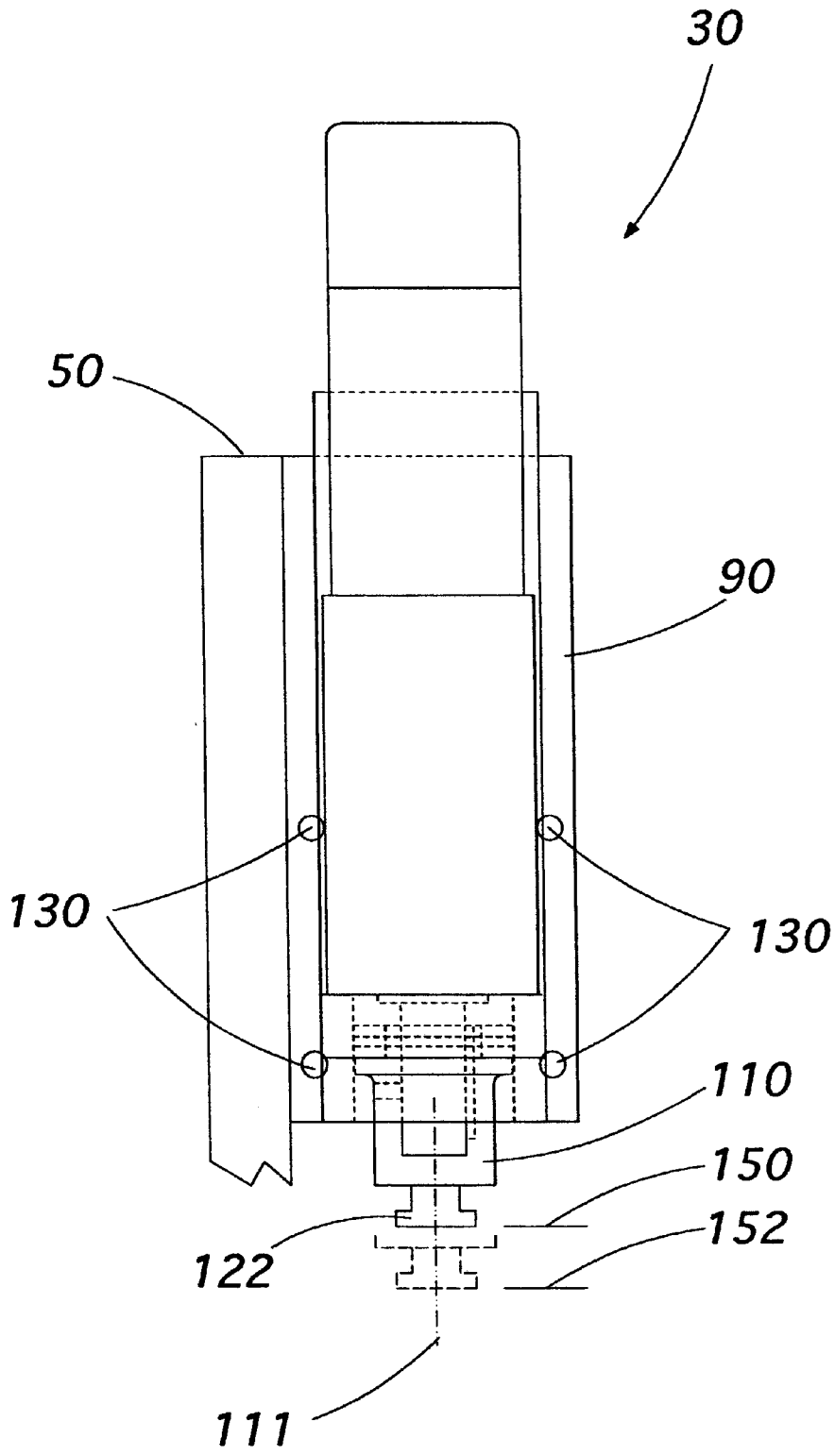
FIG. 6 is a right side view of the upper tool activator assembly shown in FIG. 5.
Figure 7:
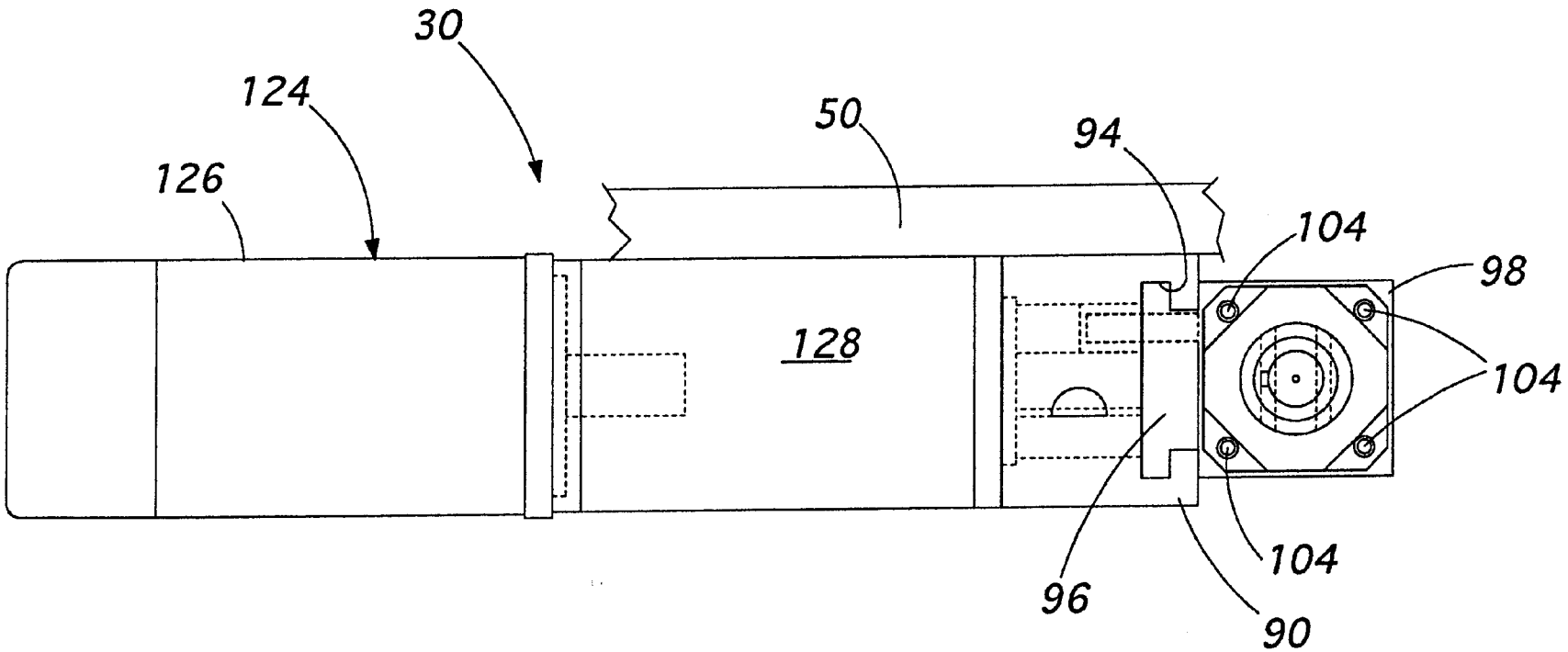
FIG. 7 is a top view of the upper tool activator assembly shown in FIG. 5.
Figure 8:
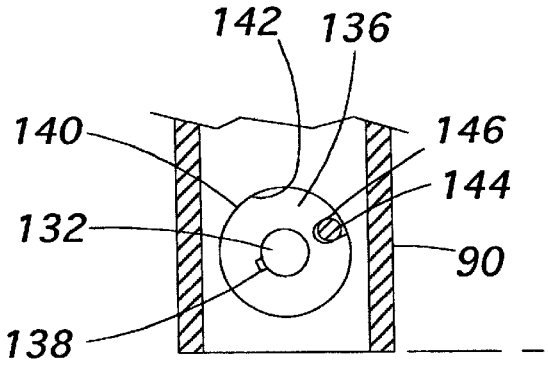
FIG. 8 is a cross-sectional view taken along the lines 8—8 in FIG. 5.
Figure 8A:
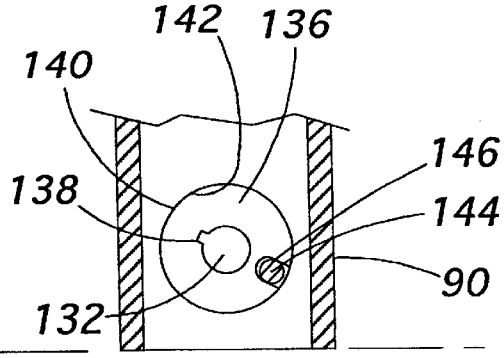
FIG. 8A is a view similar to that of FIG. 8 showing a different operating position.
Figure 9:
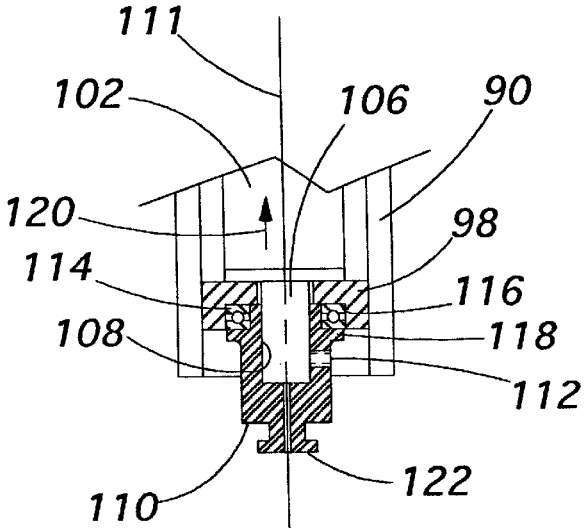
FIG. 9 is a cross-sectional view taken along the lines 9—9 in FIG. 5.

The upper tool holder assembly 30, shown enlarged in FIGS. 5, 6, and 7, includes a slide block 90 that is attached to the face of the upper slide plate 50 by means of screws 92 that extend through counter bored holes in the slide block and into threaded holes in the upper slide plate. The slide block 90 has a T-slot 94 formed therein that closely receives a slide 96 having a conformal shape so that the slide is free to move within the T-slot without appreciable side to side play. The slide 96 has a flange 98 extending outwardly therefrom at right angles, as best seen in FIG. 5. An upper tool drive motor 99 including a tool drive motor 100 and associated gear reduction unit 102 is mounted to the flange 98 by means of screws 104 that extend through counter bored holes in the flange and into threaded holes in the housing of the gear reduction unit 102. The gear reduction unit 102 includes an output shaft 106, as best seen in FIG. 9, that is a loose slip fit with a bore 108 formed in a tool coupling 110. A set screw 112 threaded into a hole in the tool coupling 110 secures the tool coupling to the output shaft 106 in the usual manner. The output shaft 106 and the tool coupling 110 have an axis of rotation, or third axis, 111 that is substantially vertical with respect to the tables 16 and 18. A thrust bearing 114 is disposed within a counter bore 116 formed in the bottom surface of the flange 98, as shown in FIG. 9, and bears against a flange 118 formed on the tool coupling 110 for absorbing axial loads in the direction of the arrow 120. A T-shaped member 122 is formed on the downwardly facing end of the tool coupling 110 for coupling to various tools, as will be explained below. By operation of the tool drive motor 100 the tool coupling 110 can be selectively rotated to position a tool during operation of the machine 10, as will be explained below. A power unit 124, consisting of a servo motor 126 and associated gear reduction unit 128, is attached to the left facing surface of the slide block 90, as viewed in FIG. 5, by means of screws 130 that are threaded into holes in the slide block. A drive shaft 132 of the power unit 124 extends from the end of the gear reduction unit into a bore 134 of a sleeve 136, as shown in FIGS. 5, 8, and 8A. The drive shaft 132 is secured to the sleeve 136 by means of a Woodruff key 138 in the usual manner. The sleeve 136 has an outside diameter 140 that is a loose slip fit with a bore 142 in the slide block 90 so that the sleeve 136 is free to rotate under the urging of the drive shaft 132. A dowel pin 144 is press fit in a hole in the slide 96 and extends outwardly therefrom toward the left, as viewed in FIG. 5, into a blind slot 146 formed in the outer periphery of the sleeve 136. This controls the vertical position of the slide 96. The power unit 124 may be actuated to rotate the sleeve 136 from the position shown in FIG. 8 where the slide 96 is in a first position 150, shown in FIGS. 5 and 6, and the tool coupling 110 is furthest away from the table 16, to the position shown in FIG. 8A where the slide 96 is in a second position 152, and the tool coupling is closest to the table 16. This motion of the slide 96 between the first and second positions moves the upper tool drive motor 99 along the vertical axis 111.

The lower tool holder assembly 32, as best seen in FIGS. 3 and 5, is somewhat similar to the upper tool holder assembly 30 and includes a lower slide plate 160 attached to a pair of movable slide members 162 by means of bolts 164 which extend through counter bored holes in the lower slide plate and into threaded holes in the slide members 162. The pair of slide members 162 are slidingly coupled to and slide along a lower rail 166 which extends the length of the frame 26 and is attached thereto at opposite ends to form an integral part of the frame. A lower tool support plate 168 is attached to the lower slide plate 166, at right angles thereto, by means of screws 170 that extend into threaded holes in the lower slide plate. Dowel pins 172 extend through slip fit holes in both the support plate 168 and the lower slide plate 160 and are spaced between adjacent screws 170 to accurately locate the support plate, in the usual manner. A T-shaped slide member 174 is attached to the upwardly facing side of the lower tool support plate 168, as best seen in FIG. 4, by means of screws 176 that extend through counter bored holes in the T-shaped member 174 and into threaded holes in the support plate 168. A lower tool holder 180 includes a T-slot 182 that is a close sliding fit with the T-shaped member 174 so that the lower tool holder is free to slide back and forth along the T-shaped member, in the directions of the arrows 34 and 36, without appreciable side play. The lower tool holder 180 includes a groove 184 that is a sliding fit with a flange 186 extending from the lower slide plate 160, as shown in FIG. 4, and serves to provide side to side stability without placing undue stress on the T-shaped member 174. Several equally spaced elongated holes 188 are formed through the lower slide plate 160 and extend the entire length of the lower slide plate. A rectangular shaped locking bolt 190 is a slip fit within an opening formed through a servo assembly 194 that is mounted to the left end of the lower tool holder 180 by means of screws 84 that extend through counter bored holes in the servo assembly and into threaded holes in the upper tool holder, as shown in FIGS. 3 and 11. The locking bolt 190 is positioned to be closely received in each of the elongated holes 188 so that the lower tool holder can be moved and then locked into any of several positions with respect to the lower slide plate 160. The servo assembly 194 is substantially similar to the servo assembly 82 and, under the command of the controller 38, moves the locking bolt 190 into and out of locking engagement with the elongated holes 188, as will be explained in more detail below.

Figure 10:
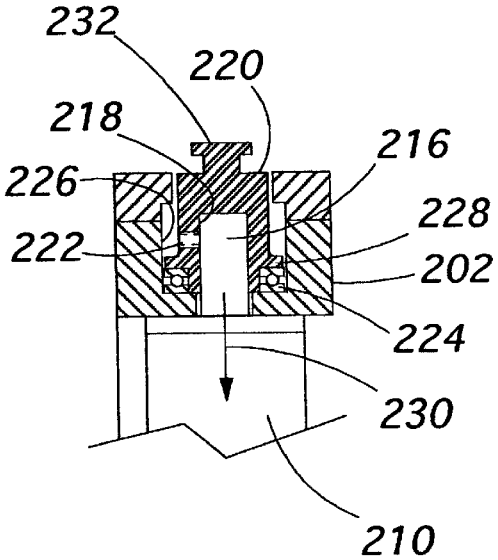
FIG. 10 is a cross-sectional view taken along the lines 10—10 in FIG. 3.

The lower tool holder assembly 32, as shown in FIGS. 3 and 4, includes a mounting block 202 that is attached to the face of the lower slide plate 160 by means of screws 204 that extend through counter bored holes in the mounting block and into threaded holes in the lower slide plate. The mounting block 202 has a cutout therein to form a mounting surface 206 to which a lower tool drive motor 208 and associated gear reduction unit 210 are mounted, as a single unit, by means of screws 212 that extend through counter bored holes in a surface 214 of the mounting block and into threaded holes in the housing of the gear reduction unit 210. The gear reduction unit 210 includes an output shaft 216, as best seen in FIG. 10, that is a loose slip fit with a bore 218 formed in a tool coupling 220. A set screw 222 threaded into a hole in the tool coupling 220 secures the tool coupling to the output shaft 216 in the usual manner. A thrust bearing 224 is disposed within a counter bore 226 formed in the mounting block 202, as shown in FIG. 10, and bears against a flange 228 formed on the tool coupling 220 for absorbing axial loads in the direction of the arrow 230. A T-shaped member 232 is formed on the upwardly facing end of the tool coupling 220 for coupling to various tools, as will be explained below. By operation of the lower tool drive motor 208 the tool coupling 220 can be selectively rotated within the bore 226 to position a tool during operation of the machine 10, as will be explained below.

Figure 12:
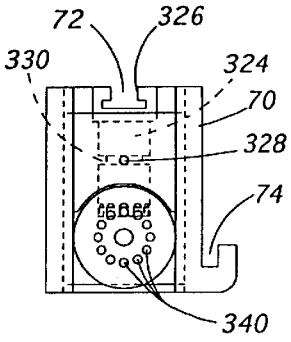
FIGS. 12 and 13 are right side and bottom views, respectively, of the upper tool holder assembly shown in FIG. 11.
Figure 14:
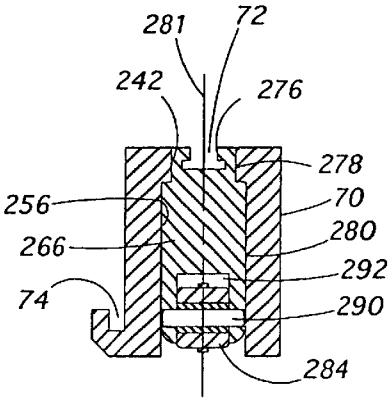
FIG. 14 is a cross-sectional view taken along the lines 14—14 in FIG. 11.
Figure 13:
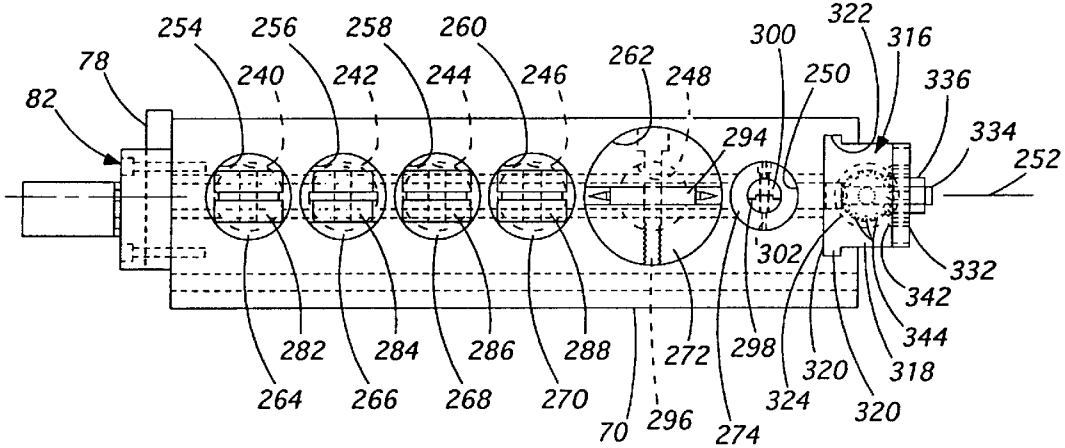

The upper tool holder 70, as shown in FIGS. 11 through 14, includes several bored holes 240, 242, 244, 246, 248, and 250, all of which are in alignment with an axis 252, as best seen in FIG. 13. The bores 240, 242, 244, 246, and 248 include counter bores 254, 256, 258, 260, and 262, respectively. The bores 240, 242, 244, 246, 248, and 250, contain cylindrically shaped tool bodies 264, 266, 268, 270, 272, and 274, respectively. Each of the tool bodies includes a T-shaped slot 276 in its upper end, as viewed in FIG. 14, that is similarly sized and in alignment with the T-slot 72 in the upper tool holder 70. Each of the tool bodies includes a diameter 278 that is a loose slip fit with its respective bore 240, 242, 244, 246, 248, and 250. The tool bodies 264, 266, 268, 270 and 272 each includes an enlarged diameter 280 that is a loose slip fit with its respective counter bore 254, 256, 258, 260, and 262. Each of the tool bodies 264, 266, 268, 270, 272, and 274 is free to rotate within its respective bore and counter bore about a vertical axis such as the vertical axis 281 in the case of the tool body 266 shown in FIG. 14. The tool bodies 264, 266, 268, and 270 include circular-shaped tools 282, 284, 286, and 288, each being journaled for rotation on a pin 290 and contained within a cutout 292 formed within the tool body. The tools 282, 284, 286, and 288 are designed for performing various manufacturing operations on the sheet of material 12 in cooperation with the tools of the lower tool holder 180, such as creasing or forming. The tool body 272 includes a disc-shaped cutting tool 294 which is journaled for rotation on a screw 296 that is threaded into a hole in the tool body. The disc-shaped tool 294 is used for making cuts through the sheet of material 12 where the material is relatively soft or spongy such as some corrugated cardboards. The tool body 274 includes a cutting tool 298 in the form of a fixed knife blade that is clamped in a jaw 300 by means of a screw 302. The knife blade is used for making cuts in relatively hard or stiff material that cannot be easily cut with the disc-shaped cutting tool 294. Note that all of the above described tool bodies and their attached tools are free to rotate and to move axially, in the direction of the arrows 304 and 306, within their respective bores in the upper tool holder 70. A marking unit 316 includes a body 318 having a pair of flanges 320 that are a sliding fit with a T-shaped slot formed in the end of the upper tool holder 70 so that the body is free to slide, with respect to the upper tool holder, in the direction of the arrows 304 and 306 without appreciable side to side play. The body 318 includes a cylindrically shaped member 324 that is free to rotate within a loose slip fit bore formed in the body 318, the member 324 having another T-shaped slot 326 formed in its upper end that is similarly sized and in alignment with the T-slot 72 in the upper tool holder 70, as best seen in FIGS. 11 and 12. A key 328 is pressed into a hole in the body 318 and engages a groove 330 formed in the cylindrical shaped member 324 to prevent axial movement of the member with respect to the body 318 yet permit rotation of the member with respect thereto. A marking wheel 332 is rotationally mounted to the side of the body 318 by means of a shoulder screw 334 that extends through a counter bored hole in the body 318 and a loose slip fit hole in the marking wheel 332 and is held in place by a nut. The marking wheel 332 has raised indicia 338 on its outer peripheral surface and includes a series of pins 340 arranged on a common bolt circle concentric with the screw 334, as best seen in FIG. 12. The pins 340 have spherically shaped heads 342 that extend toward the left, as viewed in FIGS. 11 and 13, and engage respective blind cutouts 344 equally spaced about a peripheral edge of the cylindrically shaped member 324. When the body 324 is rotated the cutouts 344 and the meshing spherical shaped heads 342 cooperate to rotate the marking wheel 332.

Figure 16:
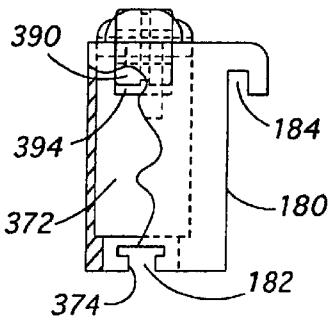
FIGS. 16 and 17 are right side and top views, respectively, of the lower tool holder assembly shown in FIG. 15.
Figure 17:
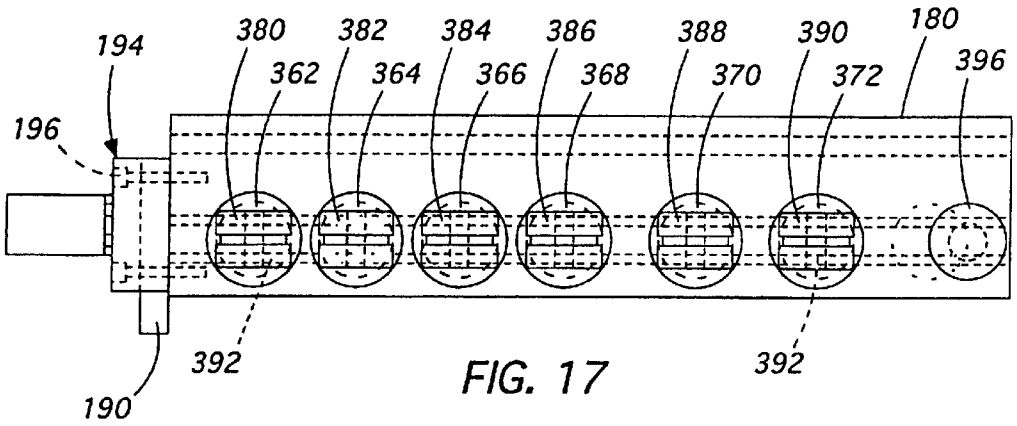
Figure 15:
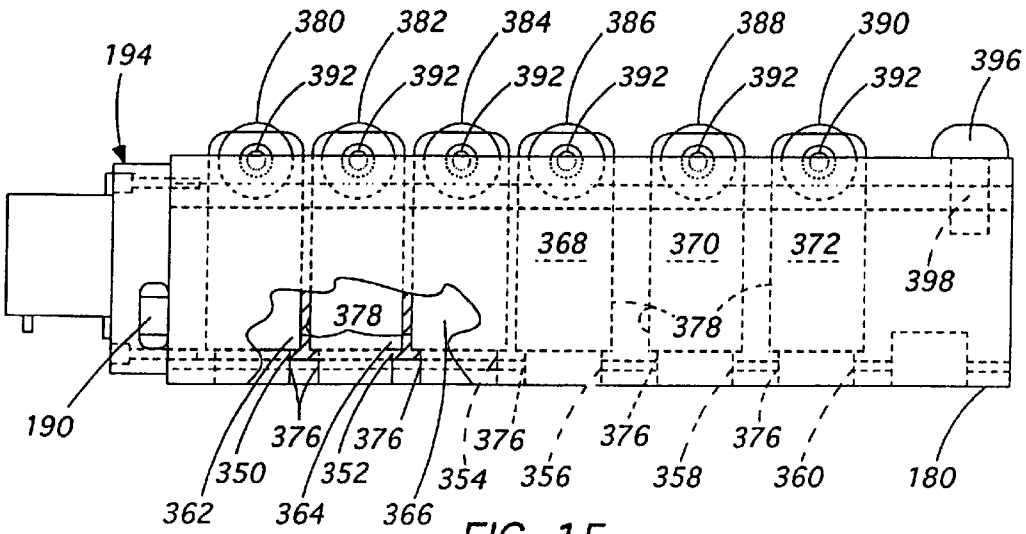
FIG. 15 is an enlarged view of the lower tool holder assembly shown in FIG. 3.

As shown in FIGS. 15, 16, and 17, the lower tool holder 180, which is similar to the upper tool holder 70, includes several bored holes 350, 352, 354, 356, 358, and 360 which are spaced identical to and in alignment with the bored holes 240, 242, 244, 246, 248, and 250, respectively, of the upper tool holder 70. Additionally, the bored holes 350, 352, 354, 356, 358, and 360 have respective counter bores which contain cylindrically shaped tool bodies 362, 364, 366, 368, 370, and 372, respectively, in a manner similar to the upper tool holder 70. Each of the tool bodies includes a T-shaped slot 374 in its lower end, as shown in FIG. 16 for the tool body 372, that is similarly sized and in alignment with the T-slot 182 in the lower tool holder 180. Each of the tool bodies includes a diameter 376 that is a loose slip fit with its respective bore 350, 352, 354, 356, 358, and 360. The tool bodies 362, 364, 366, 368, 370 and 372 each includes an enlarged diameter 378 that is a loose slip fit with its respective counter bore, in a manner similar to the upper tool holder 70. Each of the tool bodies 362, 364, 366, 368, 370, and 372 is free to rotate within its respective bore and counter bore about a vertical axis. The tool bodies 362, 364, 366, 368, 370, and 372 include circular-shaped tools 380, 382, 384, 386, 388, and 390, each being journaled for rotation on a pin 392 and contained within a cutout 394 formed within the tool body, as best seen in FIG. 16. Each of the tools 380, 382, 384, 386, 388, and 390 cooperates with a respective one of the tools 282, 284, 286, 288, 294, and 298 in performing the various manufacturing operations on the sheet of material 12 as set forth above. An anvil 396 includes a shank 398 that is pressed into a hole formed in the lower tool holder 180, as best seen in FIGS. 15 and 16. The anvil 396 cooperates in the usual manner with the marking wheel 332 in the marking of the sheet of material 12.

Figure 19:
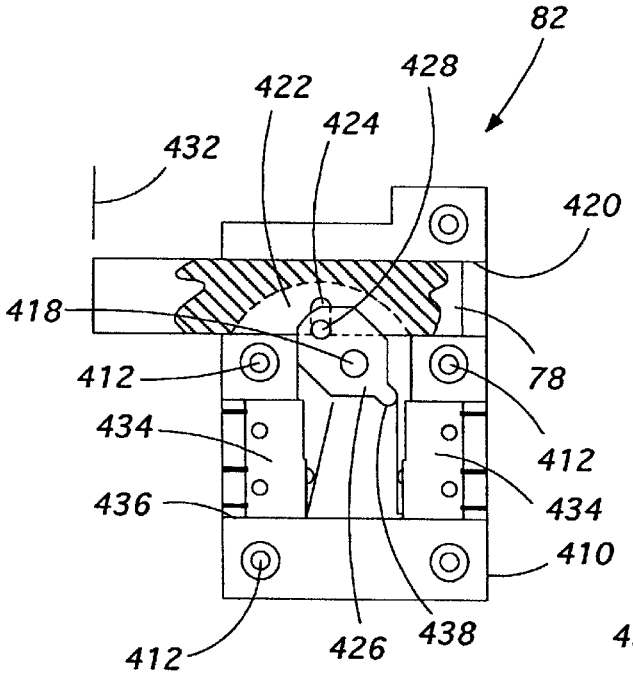
FIG. 19 is a right end view of the servo assembly shown in FIG. 18.
Figure 19A:
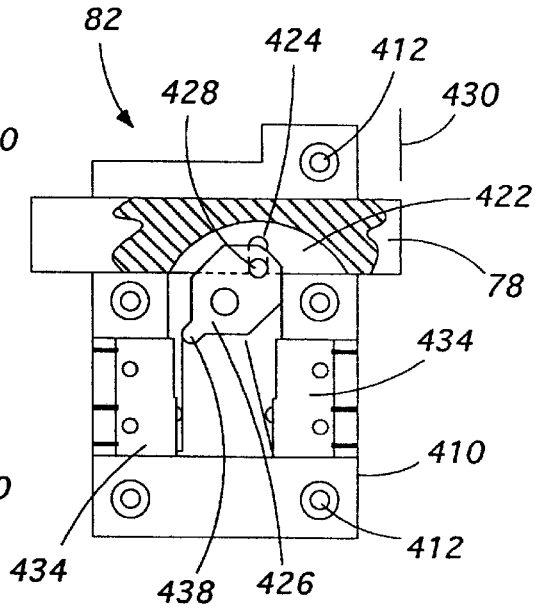
FIG. 19A is a view similar to that of FIG. 19 showing the servo assembly in a different operating position.
Figure 18:
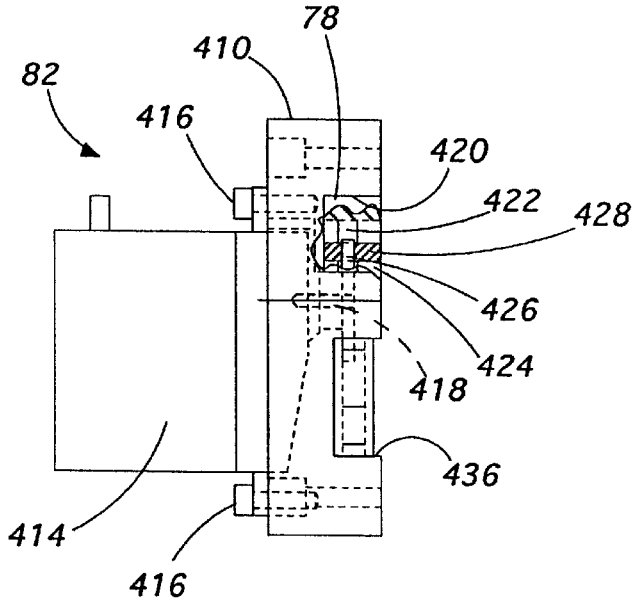
FIG. 18 is a side view of a servo assembly shown in FIG. 3.

The servo assemblies 82 and 194 are substantially similar in structure, therefore, only the servo assembly 82 will be described. The servo assembly 82, as shown in FIGS. 18, 19, and 19A, includes a mounting plate 410 having counter bored holes 412 for receiving the screws 84, as shown in FIG. 11. A servo motor 414 is mounted to the plate 410 by means of screws 416 that extend through clearance holes in a flange of the motor housing and into threaded holes in the plate. A portion of the servo motor extends into a cutout in the plate including the servo motor's output shaft 418. The locking bolt 78 is in sliding engagement with a slot 420 formed in the right most face of the plate 410, as viewed in FIG. 18. The locking bolt 78 is free to slide back and forth within the slot 420 and includes a radiussed cutout 422 formed in the lower side thereof. An open ended slot 424 is formed in the lower side of the locking bolt transverse to the cutout 422. The output shaft 418 includes a drive coupling 426 secured thereto in the usual manner, the drive coupling having a drive pin 428 extending outwardly from both sides. The drive pin 428 extends into the open ended slot 424 on both sides of the cutout 422, as best seen in FIG. 18. The servo motor 414 is operable by the controller 38 to rotate the drive coupling back and forth between a position shown in FIG. 19A where the locking bolt 78 is in a first locking position 430 and a position shown in FIG. 19 where the locking bolt is in a second locking position 432, for a purpose that will be described. A pair of micro switches 434 are attached to the plate 410 within cutouts 436. The micro switches are actuated by an extension 438 projecting from the drive coupling so that when the locking bolt 78 is in the first locking position 430 only one of the switches is actuated and when the locking bolt is in the second locking position 432 only the other of the switches is actuated. The switches 434 are electrically interconnected to the controller 38 so that the controller can sense the position of the locking bolt.

Figure 20:
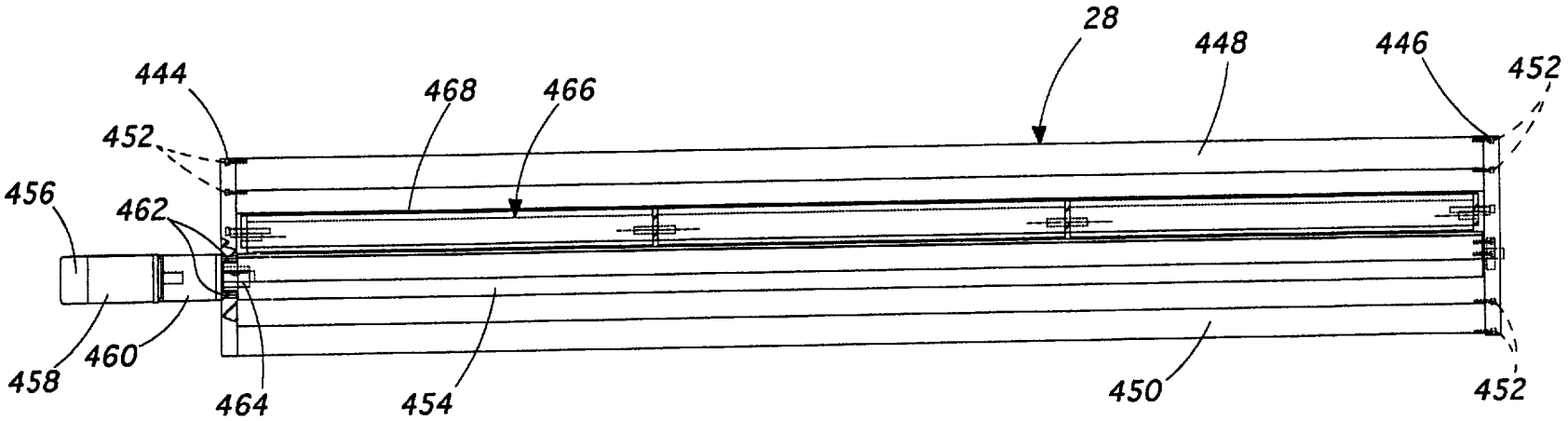
FIG. 20 is a front view of the feed roller mechanism shown in FIG. 2.
Figure 21:
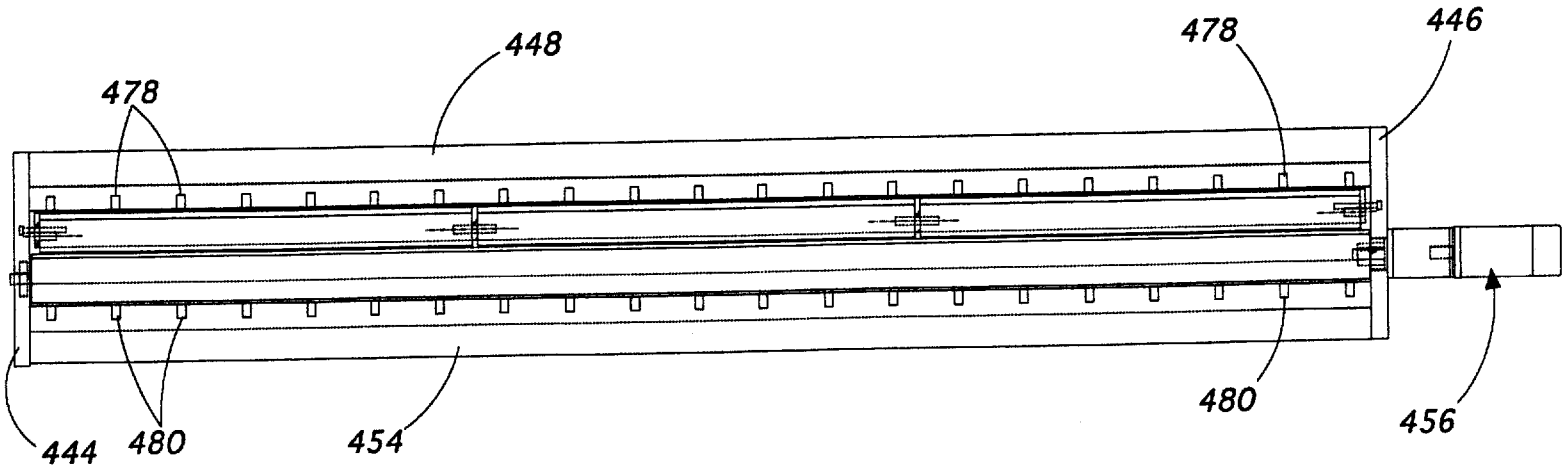
FIG. 21 is a back view of the feed roller mechanism shown in FIG. 20.
Figure 22:
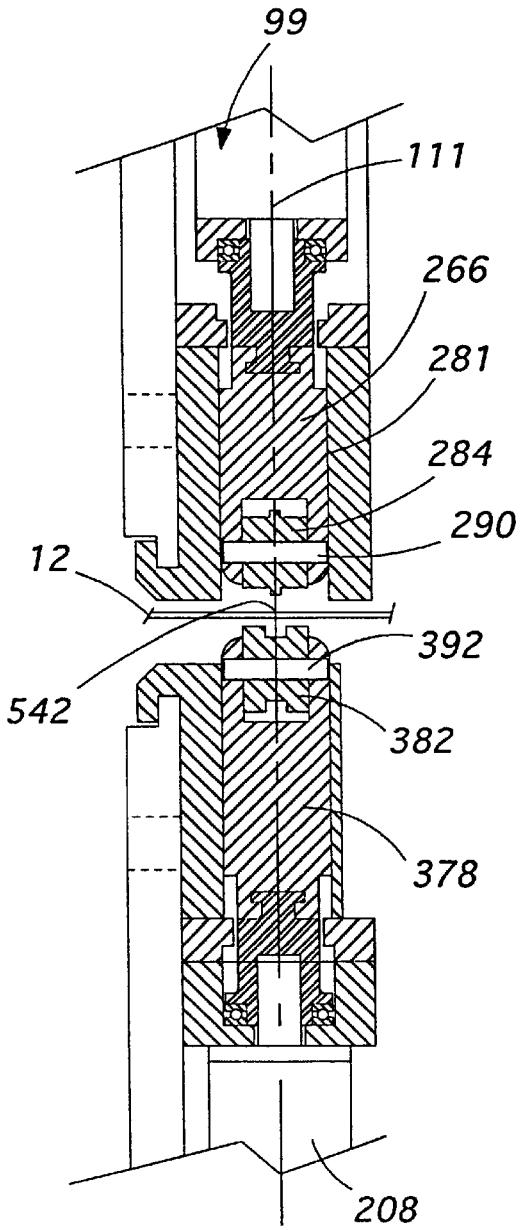
FIG. 22 is a cross-sectional view taken along the lines 22—22 in FIG. 3.
Figure 23:
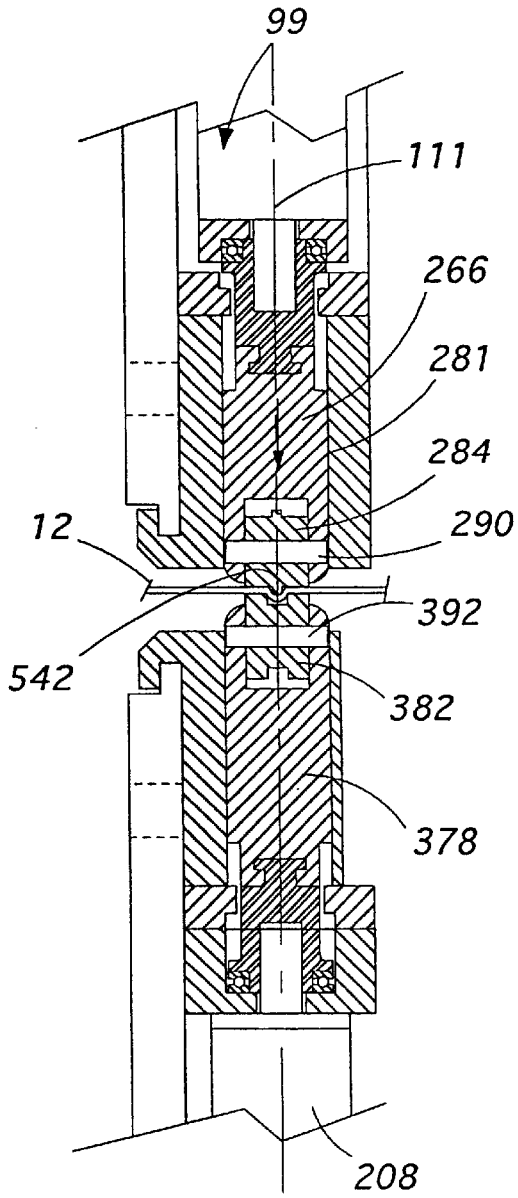
FIG. 23 is a view similar to that of FIG. 22 showing the upper and lower tools in mated engagement with the sheet of material.

The feed roller mechanism 28, as best seen in FIGS. 4, 20, and 21, includes left and right spaced apart end plates 444 and 446 attached to opposite ends of an upper rail 448 and a lower rail 450 by means of screws 452 that extend through counter bored holes in the end plates and into threaded holes in the ends of the upper and lower rails. The left and right end plates are rigidly secured to opposite ends of the frame in the position shown in FIG. 4 by means of bolts and anchor nuts, not shown. A drive roller 454 is journaled for rotation between the left and right end plates 444 and 446, extending substantially the entire distance therebetween, as shown in FIG. 20. A power unit 456 consisting of a servo motor 458 and associated gear reduction unit 460 is attached to the left facing surface of the left end plate 440 by means of screws 462 that are threaded into holes in the end plate. A drive shaft 464 of the power unit 456 extends from the end of the gear reduction unit through a support bearing in a bore in the left end plate and is drivingly coupled to the drive roller 454, as shown in FIG. 20. A three section pinch roller assembly 466 is journaled for rotation and supported by an angle bracket 468 that is pivotally attached to the left and right end plates 444 and 446 by means of two shoulder screws 470 that extend through counter bored holes in the end plates and into threaded holes in the ends of the pinch roller assembly 466. The angle bracket 468 includes a leaf spring 472 attached thereto having a free end against a portion 473 of the frame 26 so that the angle bracket is biased to pivot counterclockwise, as viewed in FIG. 4. This urges the pinch roller assembly toward the drive roller 454 and tightly against the upper surface of the sheet of material 12 during operation. As best seen in FIG. 4, an upwardly radiussed inlet guide rail 474 extends between the left and right end plates 444 and 446 and is held in place by means of screws that extend through counter bored holes in the end plates and into threaded holes in the ends of the inlet guide rail. A curved surface 476 of the inlet guide rail is arranged level with the top surface of the inlet table 16 for guiding the leading edge of the sheet of material 12 into the machine 10, as well as guiding any cut edge that may project out of the plane of the sheet of material, and prevent stubbing of these edges on the edge of the inlet table 16. As shown in FIG. 21, a row of upper elongated holes 478 are formed in the rear surface of the upper rail 448 and spaced identically to the spacing of the elongated holes 76 in the upper slide plate 50. The row of upper elongated holes 478 are positioned in opposing alignment with the elongated holes 76 so that the locking bolt 78 of the upper tool holder 70 can be closely received in either an elongated hole 76 or an opposing upper elongated hole 478. It will be noted that the row of upper elongated holes 478 extends substantially the length of the upper rail 448 resulting in many more holes 478 than holes 76. The reason for this will become apparent. Similarly, as shown in FIG. 21, a row of lower elongated holes 480 are formed in the rear surface of the lower rail 454 and spaced identically to the spacing of the elongated holes 188 in the lower slide plate 160. The row of lower elongated holes 480 are positioned in opposing alignment with the elongated holes 188 so that the locking bolt 190 of the lower tool holder 180 can be closely received in either an elongated hole 190 or an opposing elongated hole 480. Similarly, the row of elongated holes 480 extends substantially the length of the lower rail 454. Additionally, as shown in FIG. 4, there are upper and a lower outlet guide members 482 and 484 that extend for substantially the length of the feed roller mechanism 28, each end being attached to the frame 26 by means of screws, not shown. The upper and lower outlet guide members are positioned close to the upper and lower tool holders for guiding the leading edge of the sheet of material 12 during operation, as well as guiding any cut edge that may project out of the plane of the sheet of material, and prevent stubbing of these edges on the edge of the outlet table 18.

As set forth above, the upper and lower tool holder assemblies 30 and 32 are slidingly coupled to the upper and lower rails 56 and 166, which are rigidly attached to the frame 26, so that they can move lateral with respect to the first axis 24, back and forth in the directions of the arrow 34 and 36. The upper slide plate 50 has an upper drive belt 500 attached thereto by means of a screw 501 that extends through a hole in the belt-end coupling and into a threaded hole in the upper slide plate, as best seen in FIGS. 2 and 4. Similarly, the lower slide plate 166 has a lower drive belt 502 attached thereto by means of a screw 503 that extends through a hole in the belt-end coupling and into a threaded hole in the lower slide plate. The upper drive belt 500 is arranged in a continuous loop extending around a drive sprocket 504 that is journaled for rotation in the left most end of the upper rail 56 and an idler sprocket 506 that is journaled for rotation in the right most end of the upper rail. Similarly, the lower drive belt 502 is arranged in a continuous loop extending around a drive sprocket 508 that is journaled for rotation in the left most end of the lower rail 166 and an idler sprocket 510 that is journaled for rotation in the right most end of the lower rail. A coupling shaft 514 is rigidly attached to the two drive sprockets 504 and 508 so that as the coupling shaft is rotated, both upper and lower belts 500 and 502 move in concert, either left or right depending upon the rotation of the coupling shaft. Because the upper and lower belts 500 and 502 are attached to the upper and lower slide plates 50 and 166, respectively, as the coupling shaft 514 is rotated the upper and lower slide plates and, therefore, the entire upper tool holder assembly 30 and the entire lower tool holder assembly 32 move together left or right in the directions of the arrows 34 and 36, as shown in FIGS. 2 and 3. The upper and lower tool holder assemblies 30 and 32, together, form a single carriage 520 that moves back and forth along a lateral axis, or second axis, 518 which is perpendicular to both the longitudinal axis 24 and the vertical axis 111, as shown in FIG. 2. This left and right movement of the carriage 520 is effected by a power unit 522 including a servo motor 524 and an associated gear reduction unit 536 having an output shaft that is drivingly connected to the coupling shaft 514. The power unit 522 is attached to the lower rail 166 by means of screws in the usual manner. The servo motor 524 is under the operational control of the controller 38.

Figure 24:
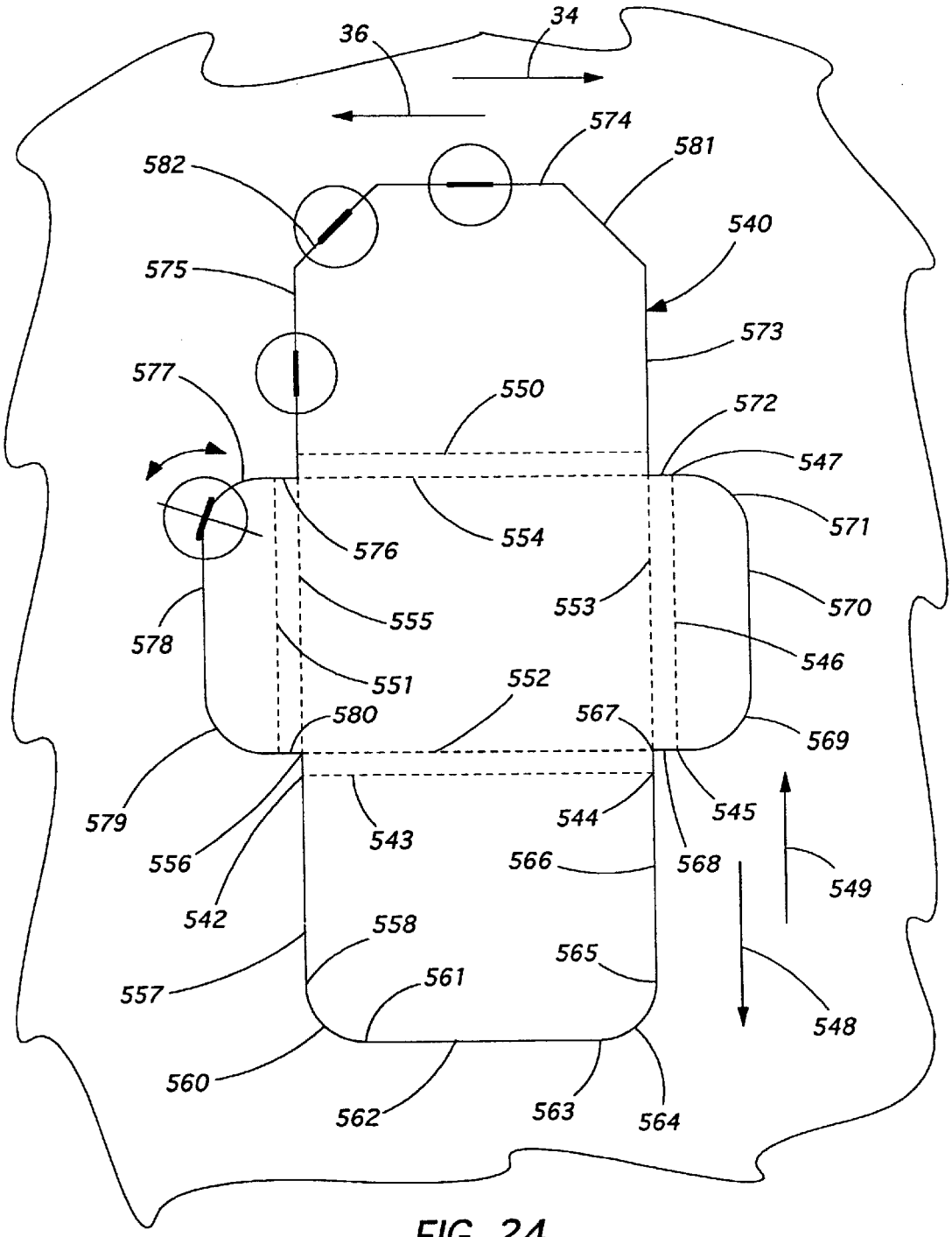
FIG. 24 is a layout of a typical flat pattern box blank.

The operation of the machine 10 will now be described with reference to FIGS. 2, 22, 23, and 24 in particular as well as other figures. The machine operator operates the controller 38 to initialize the machine by selecting the type of box to be manufactured, selecting the size of the sheet of material 12, and then indicating the desired position of the selected box on the sheet. The sheet 12 is then placed on the inlet table 16 with its leading edge in engagement with the feed roller mechanism 28 and the operator starts the machine 10. For the following discussion it will be assumed that the machine 10 has been programmed to manufacture a box blank 540, as shown in FIG. 24. The box blank 540 has eight crease lines indicated as dashed lines. The solid lines represent the outer periphery of the box blank, all of which are to be cut completely through the sheet of material 12. Therefore, there are several creasing operations and several cutting operations to be performed in the manufacture of this box blank, requiring a set of creasing tools such as upper tool 284, shown in FIG. 11, and cooperating lower tool 382, shown in FIG. 15, and a set of cutting tools such as the upper tool 298 and the cooperating lower tool 390. In this example the creasing operations will be performed prior to the cutting operations. However, it will be understood that these operations may be performed in any order including interleaving cutting operations with creasing operations.

The controller 38 checks to see if the upper and lower tools 284 and 382 are in alignment with the vertical axis 111. If not, the controller 38 operates the servos 82 and 194 to cause the locking bolts 78 and 190 to simultaneously move toward the right, as viewed in FIG. 4, and engage respective upper and lower elongated holes 478 and 480. The power unit 522 is then operated to move the carriage 520 toward the left or right in the direction of the arrows 34 or 36, which ever is appropriate, until the axis 281 of the upper tool 284 is in alignment with the vertical axis 111 of the output shaft 106. During this movement the T-shaped member 64 slides freely through the T-slot 72 in the upper tool holder 70. The carriage 520 is stopped in this position and the servo 82 is again operated to move the locking bolt 78 toward the left, as viewed in FIG. 4, into engagement with an elongated hole 76, thereby fixing the upper tool holder 70 to the upper slide plate 50. If the desired lower tool 382 is not in alignment with the vertical axis 111 then the power unit 522 is operated to move the carriage, in the appropriate direction, until the lower tool is in alignment. During this movement the T-shaped member 174 slides freely through the T-slot 182 in the lower tool holder 180. The carriage 520 is then stopped in this position and the servo 194 is operated to move the locking bolt 190 toward the left, as viewed in FIG. 4, into engagement with an elongated hole 188, thereby fixing the lower tool holder 180 to the lower slide plate 160. It will be understood that each of the upper tools may be positioned in alignment with the axis 111 independently of the lower tools. Conversely, each of the lower tools may be positioned in alignment with the axis 111 independently of the upper tools. The power unit 522 is again operated to move the carriage 520 along the axis 518 and, simultaneously the power unit 456 is operated to move the sheet of material 12 along the axis 24 until the vertical axis 111 extending through the upper and lower tools 284 and 382 intersects the point 542, shown in FIGS. 22 and 24. The carriage 520 and the sheet 12 are then stopped in position and the upper tool drive motor 99 and lower tool drive motor 208 are operated in unison to rotate the upper and lower tools so that their pins 290 and 392 upon which the tool rotate are perpendicular to the desired crease line 543 shown in FIG. 24. The power unit 124 is then operated to move the upper tool 284 downwardly, as viewed in FIG. 23, so that the upper tool engages the upper surface of the sheet 12, deflecting it downwardly a slight amount into engagement with the lower tool, where the two tools cooperate in creasing the sheet 12 at the point 542. The power unit 522 is then operated to move the carriage 520 toward the right, as viewed in FIG. 2; in the direction of the arrow 34, so that the upper and lower tools 284 and 382 form the desired crease line 543 until they reach the point 544 when the carriage and the sheet 12 are stopped in position. The power unit 124 is operated to move the upper tool 284 upwardly away from the sheet 12 to the position shown in FIG. 23. The upper tool drive motor 99 and lower tool drive motor 208 are operated in unison to rotate the upper and lower tools so that their pins 290 and 392 upon which the tool rotate are perpendicular to the next desired crease line 546 shown in FIG. 24. The power unit 124 is then operated to move the upper tool 284 downwardly, as viewed in FIG. 23, so that the upper tool engages the upper surface of the sheet 12, deflecting it downwardly a slight amount into engagement with the lower tool to the position shown in FIG. 23, where the two tools cooperate in creasing the sheet 12 at the point 545. The power unit 456 is then operated to move the sheet 12 in the direction of the arrow 548 so that the upper and lower tools 284 and 382 form the desired crease line 546 until they reach the point 547 when the carriage and the sheet 12 are again stopped in position. The power unit 124 is operated to again move the upper tool 284 upwardly away from the sheet 12 to the position shown in FIG. 23. Similarly, the crease lines 550 through 555 are formed in the sheet 12, except that when forming the crease lines 550 and 554 the power unit 522 is operated to move the carriage 520 to the left, as viewed in FIG. 2, in the direction of the arrow 36, and when forming the crease lines 551 and 555 the power unit 456 is operated to move the sheet 12 in the direction of the arrow 549.

This completes the creasing operations and, therefore, will require a tool change to proceed with the cutting operations. The power unit 522 is operated to move the carriage 520 until the locking bolts 78 and 190 are in alignment with respective upper and lower elongated holes 478 and 480. The servos 82 and 194 are then operated to cause the locking bolts 78 and 190 to move toward the right, as viewed in FIG. 4, and engage these respective upper and lower elongated holes 478 and 480. The power unit 522 is then operated to move the carriage 520 toward the right in the direction of the arrow 34 until the axis of the upper tool 298 is in alignment with the vertical axis 111 of the output shaft 106. During this movement the T-shaped member 64 slides freely through the T-slot 72 in the upper tool holder 70. The carriage 520 is stopped in this position and the servo 82 is again operated to move the locking bolt 78 toward the left, as viewed in FIG. 4, into engagement with an elongated hole 76, thereby fixing the upper tool holder 70 to the upper slide plate 50. If the lower tool 390 is not in alignment with the vertical axis 111 the power unit 522 is operated to move the carriage, in the appropriate direction, until the lower tool is in alignment. During this movement the T-shaped member 174 slides freely through the T-slot 182 in the lower tool holder 180. The carriage 520 is then stopped in this position and the servo 194 is operated to move the locking bolt 190 toward the left, as viewed in FIG. 4, into engagement with an elongated hole 188, thereby fixing the lower tool holder 180 to the lower slide plate 160. The power unit 522 is again operated to move the carriage 520 along the axis 518 and, simultaneously the power unit 456 is operated to move the sheet of material 12 along the axis 24 until the vertical axis 111 extending through the upper and lower tools 298 and 390 intersects the point 556, shown in FIG. 24. The carriage 520 and the sheet 12 are then stopped in position and the upper tool drive motor 99 and lower tool drive motor 208 are operated in unison to rotate the upper and lower tools so that they are aligned with the desired cut line 557 shown in FIG. 24. The power unit 124 is then operated to move the upper cutting tool 298 downwardly, as viewed in FIG. 22, so that the upper tool engages the upper surface of the sheet 12, deflecting it downwardly a slight amount into engagement with the lower tool, where the two tools cooperate in cutting the sheet 12 at the point 556. The power unit 456 is then operated to move the sheet 12 in the direction of the arrow 549 so that the upper and lower tools 298 and 390 cut along the desired cut line 557 until they reach the point 558 when the sheet 12 continues to move in the direction of the arrow 549 and the power unit 522 is simultaneously operated to move the carriage 520 toward the right in the direction of the arrow 34, as viewed in FIG. 2. Simultaneously, the upper tool drive motor 99 and lower tool drive motor 208 are operated in unison to rotate the upper and lower tools so that they remain tangent to the curve as they track the curved cut line 560 until they reach the point 561. The ratio of movement of the carriage 520 and the sheet 12 is adjusted so that the desired curve is tracked. At this point the upper and lower tools 298 and 390 are properly aligned to track along the cut line 562 and the power unit 456 is stopped to stop the movement of the sheet 12 while the movement of the carriage 520 continues until the tools reach the point 563 . The movement of the carriage continues and the power unit 456 simultaneously moves the sheet 12 in the direction of the arrow 548 while the upper tool drive motor 99 and lower tool drive motor 208 are operated in unison to rotate the upper and lower tools so that they track along and cut the desired curved cut line 564 to the point 565, at which the power unit 522 stops the carriage 520 but the sheet 12 continues to move in the direction of the arrow 548 so that the tools cut along the desired cut line 566 to the point 567. In a similar manner, the cut lines 568 through 580 are formed in the sheet 12. The angled cut lines 581 and 581 are made in a manner similar to the curved cut lines 571 and 577, respectively, except that the ratio of movement between the carriage 520 and the sheet 12 in their respective directions is varied to achieve a straight line instead of a curved line.

Figure 25:
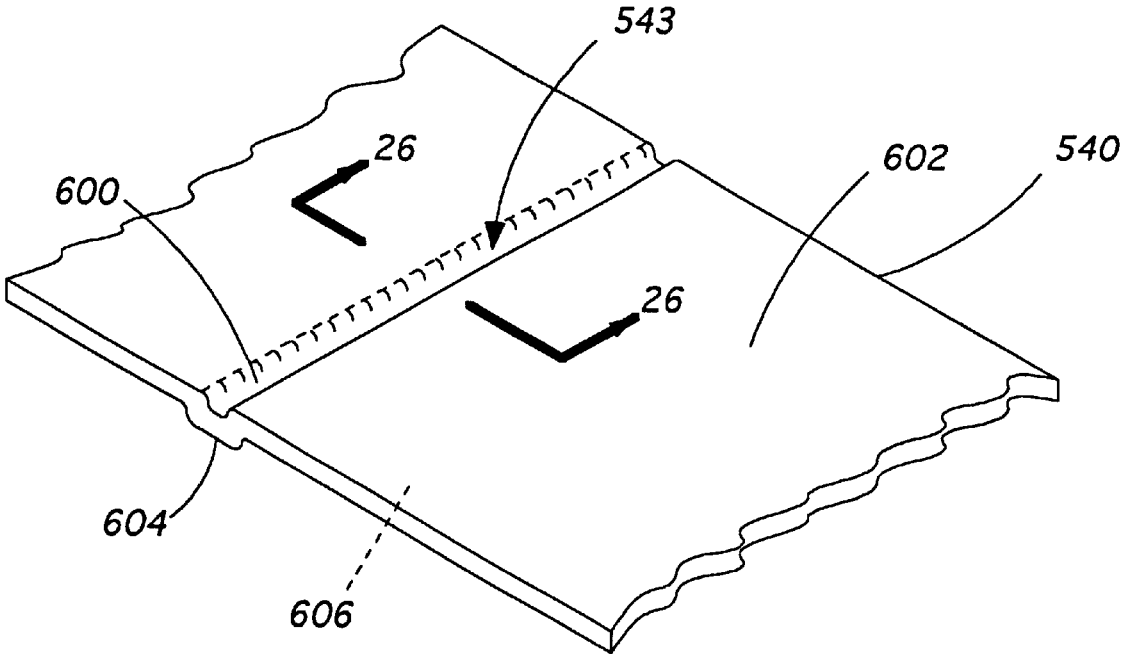
FIG. 25 is an isometric view of a portion of the box blank shown in FIG. 24.
Figure 26:
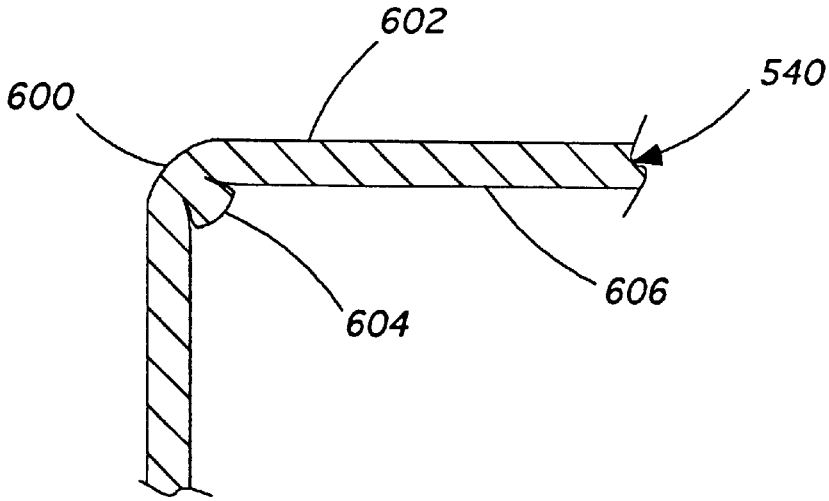
FIG. 26 is a cross-sectional view taken along the lines 26—26 in FIG. 25, showing the portion of the box blank bent to form a corner.

The creasing operation described above, utilizing the tools 284 and 382, forms a unique crease line. A portion of the box blank 540 is shown in FIG. 25 and includes the crease line 543 having an indent 600 in the upwardly facing surface 602 and an out-dent 604 projecting outwardly from the bottom facing surface 606. FIG. 26 is a cross-sectional view of the portion of the box blank 540 of FIG. 25 but shown in its final folded form. Note that the indent 600 of the crease line 543 forms a smooth outer corner without any fractures or splits while the out-dent 604 bulges inwardly to form a tiny filet on the inside corner. Crease lines formed by conventional equipment that have no out-dent capability, when folded tend to pivot about the inner surface of the inside corner thereby requiring the outside corner surface to stretch beyond its capacity and tear. The Crease line 543, on the other hand, when folded, tends to pivot at the bottom of the indent 600 causing the excess material, which is the out-dent 604, to form the filet.

While the above description was directed to a machine for manufacturing boxes it will be understood that the teachings of the present invention can be applied to any manufacturing operation that can be suitably performed with two opposing tools simultaneously and cooperatively engaging opposite sides of a sheet of material. It will be understood that the various upper and lower tools can be selected for use in any order that is appropriate to expeditiously complete the box blank or other item being manufactured. Since the upper tool holder 70 is independently movable with respect to the lower tool holder 180, any upper tool can be paired with any lower tool, the paired tools can then be brought into alignment with the axis 111 and mutually cooperate to perform a manufacturing operation on the sheet 12. Additionally, selected upper and lower tools can be selectively rotated about the axis 111 during simultaneous movement of the carriage 520 and the sheet of material 12, to track curved and angled paths for forming complex shapes.

An important advantage of the present invention is that a crease can be formed in a sheet of material so that a portion of the material projects out of the plane of the surface along the crease line which permits folding of the material along the crease line without fracturing or tearing the material. Additionally, a single power unit advantageously serves the dual purpose of driving the carriage during cutting and creasing operations and driving the carriage while changing tools. Further, the upper and lower tools are rotatable about their axis during movement of the carriage and movement of the sheet of material for forming complex shapes.

What is claimed is:

1. A machine for performing a manufacturing operation on a sheet of material comprising:

(1) a frame having a table for supporting said sheet of material;

(2) an upper tool coupled to said frame for engaging an upper surface of said sheet of material and a lower tool coupled to said frame and mateable with said upper tool for engaging a lower surface of said material opposite to said upper surface, said upper and lower tools arranged to cooperate in performing said manufacturing operation; and (3) a drive mechanism coupled to said frame for causing relative movement between said upper and lower tools and said sheet of material, wherein said sheet of material moves back and forth along a first axis parallel to said table and said upper and lower tools move back and forth along a second axis parallel to said table and substantially perpendicular to said first axis while performing said manufacturing operation, whereby, said manufacturing operation is performed when said relative movement is only along said first axis, when said relative movement is only along said second axis, and when said relative movement is along a combination of both said first axis and said second axis.

2. The machine according to claim 1 wherein said drive mechanism includes a longitudinal drive associated with said frame for engaging and selectively moving said sheet of material back and forth with respect to said frame along said first axis.

3. The machine according to claim 2 wherein said longitudinal drive includes at least one roller journaled for rotation in said frame having an axis of rotation that is perpendicular to said first axis and a first power unit coupled to said at least one roller for effecting said rotation.

4. The machine according to claim 3 wherein said drive mechanism includes a lateral drive associated with said frame for selectively moving said upper and lower tools back and forth along said second axis in the performing of said manufacturing operation.

5. The machine according to claim 4 wherein said lateral drive includes a carriage in sliding engagement with said frame and driven by a second power unit for undergoing back and forth movement in a direction parallel to said second axis, said upper and lower tooling being carried by said carriage for effecting said selective moving of said upper and lower tools along said second axis.

6. The machine according to claim 5 including:

(1) a third power unit for selectively causing a corresponding pair of said upper and lower tools to operationally engage said sheet of material only when in alignment with a third axis, said third axis being substantially perpendicular to said table; and (2) an upper tool holder for receiving at least two of said upper tools and a lower tool holder for receiving at least two of said lower tools corresponding to said upper tools wherein said upper and lower tool holders are slidingly coupled to said carriage so that each of said at least two upper tools is selectively movable into said alignment with said third axis and each of said at least two lower tools is selectively movable into alignment with said third axis.

7. The machine according to claim 6 wherein said selective movement of said at least two upper and lower tools into said alignment with said third axis is effected by said first power unit.

8. The machine according to claim 6 wherein:

when one of said upper tools and a corresponding one of said lower tools are in said alignment with said third axis, said third power unit can be actuated to cause said one of said upper and lower tools to operationally engage said sheet of material to perform said manufacturing operation during said relative movement along said first axis, and when another of said upper tools and a corresponding another of said lower tools are in said alignment with said third axis, said third power unit can be actuated to cause said another of said upper and lower tools to operationally engage said sheet of material to perform said manufacturing operation during said relative movement along said second axis.

9. The machine according to claim 8 including upper locking means for selectively securing said upper tool holder to said carriage for holding any one of said at least two upper tools in said alignment with said third axis, and lower locking means for selectively securing said lower tool holder to said carriage for holding any one of said at least two lower tools in said alignment with said third axis.

10. The machine according to claim I including an upper tool holder for receiving said upper tool and a lower tool holder for receiving said lower tool wherein said upper and lower tools are selectively movable between first and second positions within their respective tool holders so that when in said first position said upper and lower tools are aligned to perform said manufacturing operation during said relative movement along said first axis, and when in said second position said upper and lower tools are aligned to perform said manufacturing operation during said relative movement along said second axis.

11. The machine according to claim 10 wherein said upper and lower tools are separately selectively movable between said first and second positions while performing said manufacturing operation during said relative movement along both said first axis and said second axis.

12. The machine according to claim 11 wherein said selective movement of said upper and lower tools is rotational movement about an axis perpendicular to said sheet of material.

13. The machine according to claim 1 including an upper tool holder for receiving at least two of said upper tools and a lower tool holder for receiving at least two of said lower tools corresponding to said upper tools wherein said upper and lower tool holders are selectively movable between:

a first position with respect to said frame where one of said upper tools and a corresponding one of said lower tools are aligned with a third axis substantially perpendicular to said table to perform a portion of said manufacturing operation during said relative movement along said first axis, and a second position with respect to said frame where another of said upper tools and a corresponding another of said lower tools are aligned with said third axis to perform another portion of said manufacturing operation during said relative movement along said second axis.

14. The machine according to claim 13 including a carriage in sliding engagement with said frame for undergoing back and forth movement in a direction parallel to said second axis, said upper and lower tooling holders being carried by said carriage for effecting said selective moving of said upper and lower tools.

15. A machine for performing a manufacturing operation on a sheet of material comprising:

(1) a frame having a table for supporting said sheet of material;

(2) two separate upper tools coupled to said frame for individually engaging an upper surface of said sheet of material and two separate lower tools coupled to said frame, each being mateable with a corresponding one of said two upper tools, for individually engaging a lower surface of said material opposite to said upper surface, each said upper tool and said corresponding lower tool arranged to cooperate in performing said manufacturing operation;

(3) a drive mechanism coupled to said frame for causing relative movement between said upper and lower tools and said sheet of material, wherein said sheet of material moves back and forth along a first axis parallel to said table and said upper and lower tools move back and forth along a second axis parallel to said table and substantially perpendicular to said first axis while performing said manufacturing operation, said drive mechanism including a carriage in sliding engagement with said frame and driven by a second power unit for undergoing back and forth movement in a direction parallel to said second axis, said upper and lower tooling being carried by said carriage during said selective moving of said upper and lower tools.

16. The machine according to claim 15 wherein said drive mechanism includes a third power unit for selectively causing a corresponding pair of said upper and lower tools to operationally engage said sheet of material only when in alignment with a third axis substantially perpendicular to said table, said machine including an upper tool holder for receiving said two upper tools and a lower tool holder for receiving said two lower tools wherein said upper and lower tool holders are slidingly coupled to said carriage so that each of said two upper tools is selectively movable into said alignment with said third axis and each of said lower tools is selectively movable into alignment with said third axis.

17. The machine according to claim 16 including upper locking means associated with said upper tool holder for selectively securing said upper tool holder to said frame when aligning a desired said upper tool with said third axis, and lower locking means associated with said lower tool holder for selectively securing said lower tool holder to said frame when aligning a desired said lower tool with said third axis.

18. The machine according to claim 17 wherein said upper locking means is arranged to selectively secure said upper tool holder to said carriage while performing said manufacturing operation, and wherein said lower locking means is arranged to selectively secure said lower tool holder to said carriage while performing said manufacturing operation.

19. In a method of performing a manufacturing operation on a sheet of material having an upper surface and a lower surface, utilizing a machine having (a) a frame having a table for supporting said sheet of material;

(b) an upper tool coupled to said frame and a lower tool coupled to said frame and mateable with said upper tool, said upper and lower tools arranged to cooperate in performing said manufacturing operation; and (c) a drive mechanism coupled to said frame for causing relative movement between said upper and lower tools and said sheet of material, wherein said sheet of material moves back and forth along a first axis parallel to said table and said upper and lower tools move back and forth along a second axis parallel to said table and substantially perpendicular to said first axis while performing said manufacturing operation, the steps of:

(1) causing said upper and lower tools to operationally engage said upper and lower surfaces of said sheet of material;

(2) causing said drive mechanism to effect said relative movement along said first axis while performing a portion of said manufacturing operation; and (3) causing said drive mechanism to effect said relative movement along said second axis while performing another portion of said manufacturing operation.

20. The method according to claim 19 wherein said machine includes an upper tool holder for receiving said upper tool and a lower tool holder for receiving said lower tool wherein said upper and lower tools are selectively movable between first and second positions within their respective tool holders, the steps of:

prior to step (2) moving said upper and lower tools into their said first positions, and prior to step (3) moving said upper and lower tools into their second positions.

21. The method according to claim 20 wherein said moving prior to steps (2) and (3) is rotating about an axis perpendicular to said sheet of material said upper and lower tools in their respective upper and lower tool holders.

22. The method according to claim 20 including the step of moving said upper and lower tools between their respective first and second positions concurrently with performing step (3).

23. The method according to claim 19 wherein said drive unit includes:

(a) a carriage driven by a second power unit to move back and forth in a direction parallel to said second axis;

(b) an upper tool holder for receiving two of said upper tools and a lower tool holder for receiving two of said lower tools corresponding to said upper tools, (c) a third power unit for selectively causing a corresponding pair of said upper and lower tools to move along a third axis substantially perpendicular to said table and operationally engage said sheet of material only when in alignment with said third axis, wherein said upper and lower tool holders are slidingly coupled to said carriage so that each of said two upper tools is selectively movable into said alignment with said third axis and each of said two lower tools is selectively movable into alignment with said third axis, the steps:

(4) actuating said second power unit to effect said movement of said carriage until a desired upper tool and corresponding lower tool is in said alignment with said third axis; then (5) performing steps (1) and (2);

(6) actuating said second power unit to effect said movement of said carriage until a different upper tool and corresponding lower tool is in said alignment with said third axis; then (7) performing steps (1) and (3).

* * * * *